United States Patent [19]

Avidan

[11] Patent Number: 4,915,037

[45] Date of Patent: Apr. 10, 1990

[54] CIRCULATING FLUID BED COMBUSTION WITH CO COMBUSTION PROMOTER

[75] Inventor: Amos A. Avidan, Yardley, Pa.

[73] Assignee: Mobil Oil Corporation, New York, N.Y.

[21] Appl. No.: 270,931

[22] Filed: Nov. 14, 1988

[51] Int. Cl.[4] ..... F23B 7/00

[52] U.S. Cl. ..... 110/342; 110/345; 110/347; 431/7

[58] Field of Search ..... 110/342, 343, 344, 345, 110/347; 431/7

[56] References Cited

U.S. PATENT DOCUMENTS 4,388,877 6/1983 Mulayem et al. ..... 110/342

4,515,092 5/1985 Walsh et al. ..... 110/342

4,579,070 4/1986 Lin et al. ..... 110/345

4,735,705 4/1988 Burk, Jr. et al. ..... 110/345

*Primary Examiner*—Edward G. Favors

*Attorney, Agent, or Firm*—Alexander J. McKillop; Charles J. Speciale; Richard D. Stone

[57] ABSTRACT

Addition of a readily fluidizable, but fast settling, 400–1200 micron average diameter particulate CO combustion promoter to a circulating fluid bed (CFB) combustion unit improves the efficiency of CO burning, reduces emissions of CO and improves the efficiency of the unit. The CO combustion promoter accumulates in, or just above, in the fast fluidized bed combustion zone of the CFB.

18 Claims, 3 Drawing Sheets

CIRCULATING FLUID BED COMBUSTION WITH CO COMBUSTION PROMOTER

FIELD OF THE INVENTION

This invention relates to circulating fluid bed combustors.

BACKGROUND

Fluidized bed combustion is a mature technology. Many fluidized bed processes where combustion occurs are known, including the regenerators associated with fluidized catalytic cracking (FCC) units, fluidized coal combustors, and "regenerators" associated with fluid cokers.

Many fluidized bed combustion processes achieve only partial combustion of carbon (in coke, hydrocarbon or coal) to $CO_2$. Partial combustion, to CO, represents a loss of energy and a source of air pollution.

In FCC regenerators, it is known to add a CO combustion promoter, such as PT, to the circulating catalyst inventory. Adding 0.1–10, usually 0.5–2 wt ppm Pt is common in FCC processes to achieve complete CO combustion. The Pt makes the regenerator run hotter, because of the more complete CO combustion. More air is added per unit weight of carbon burned, because more $CO_2$ is formed at the expense of CO. Although CO emissions are much reduced, there is an increase in $NO_x$ emissions, probably because of the more oxidizing atmosphere.

The Pt promoter lasts a long time in commercial FCC units, having an activity or catalyst life similar to that of the conventional FCC catalyst, which remains in the unit for months.

Similar results are noted in the Thermofor Catalytic Cracking (TCC) Process which is a moving bed analog to the FCC process.

Both FCC and TCC possesses involve fairly clean feeds (heavy hydrocarbons) and stable, long lasting catalysts which are an ideal support for CO combustion promoters such as Pt.

Use of CO combustion promoters has been recommended for fluidized bed coke combustion. In U.S. No. 4,515,092 (Walsh et al), which is incorporated herein by reference, and in a related publication by Walsh et al entitled "A Laboratory Study of Petroleum Coke Combustion: Kinetics and Catalytic Effects", addition of sand-containing 0.1 and 1.0 wt.% Pt, is reported to promote CO combustion in a single fluidized bed of coke operating at 505° C.

A recent development has been the commercialization of circulating fluid bed (CFB) boilers.

In CBF units, operation is complex. Fuel, usually a low grade fuel with a lot of sulfur and other comtaminants, e.g. coal, is burned in a riser combustor. The flow regime is primarily that of a fast fluidized bed, i.e., there are no large "bubbles". Motove force for the fast fluidized bed is usually combustion air added at the base of the riser. There is usually an extremely large range of particle sizes in CFB units.

Combustion air is generally added to the base of the fast fluidized bed, and the resulting flue gas is discharged from the top of the fast fluidized bed, generally into a cyclone separator which covers most of the larger particles, typically 100 microns plus, while allowing finer materials (fly ash) to be discharged with the flue gas. Solids recovered by the cyclone are recycled into the fast fluidized bed.

Heat is removed from the CFG units in many places. CFB units take advantage of the extremely high heat transfer rates which are obtainable in fluidized beds, and provide for one or more areas of heat recovery from the fluidized bed. Most units have at least one relatively dense phase fluidized bed heat exchanger intermediate the cyclone separator solids discharge and the fast fluidized bed combustor.

Fluid flow in CFBs is complex because of the tremendous range in particle size of materials which must be handled by many CFBs. When coal is the feed to a CFB unit, the particle size distribution can range from submicron particles to particles of several inches in diameter.

Submicron to several micron particles present include fly ash, ground dolomite or limestone, and perhaps a few particles of ground coal.

Particles less than 100 microns in diameter usually have a short life on CFB units, because the low efficiency cyclones usually associated with such units must be able to let the fly ash out, while retaining essentially all of the 100+micron material, which usually represents coal, or ground sulfur absorbing material such as dolomite.

The 100 micron-300 micron material in a CFB represents much of the circulating particulate inventory. Usually this material is the dolomite, limestone, and similar materials used as an $SO_x$ acceptor, and some portion of the low grade fuels such as coal. When clean, or at least low sulfur, fuels such as wood chips are burned, the sulfur acceptor is not needed and sand, or some other inert is provided for fluidization.

The coal particles may range in size from several inches when first added to the fast fluidized bed to theoretically submicron particles produced by explosion or disintegration of large size particles of coal. The majority of the coal is in large particles, typically 300–1000 microns, which tend to remain in a lower portion of the CFB, by elutriation.

Many CFB units are designed to handle small amounts of agglomerated ash. At the temperature at which CFBs operate (usually 1550°–1650° F.) there is much sintering of ash, which forms larger and larger particles. Many CFBs are designed to allow large ash agglomerates, typically in the order of 1000–2000 microns to drop out of the bottom of the CFB unit, to be removed intermittantly.

The chemical reactions occurring during CFB operation are complex. Coke combustion, reactions of sulfur and nitrogen compounds with adsorbents, reactions of $NO_x$ with reducing gases (such as CO which may be present), etc., are representative reactions.

Despite the explosive growth in CFB technology (from no commercial units in 1978 to about 100 commercial units operating or under construction in 1988) I realized that the technology had some shortcomings. Particularly troublesome was the tendency of the units to all operate at the same exceedingly high temperature, which causes some metallurgical, operational and pollution problems. CFBs also operate with far more air than is required by stoichiometry.

Typical circulating fluidized bed designs are disclosed in U.S. Pat. No. 4,776,288 and U.S. Pat. No. 4,688,521, which are incorporated by reference.

Circulating fluid bed combustion systems operating with staged air injection, or staged firing, as disclosed in U.S. Pat. No. 4,462,341 or in a reducing mode circulating fluid bed combustion unit, such as disclosed in U.S. Pat. No. 4,579,070 will minimize somewhat $NO_x$ emissions. The contents of both of these patents are incorporated herein by reference.

Separation means used to remove circulating solids from flue gas may comprise cyclones, or the gas and particle separation means disclosed in U.S. No. 4,442,797 which is incorporated herein by reference.

I reviewed the state of the art in circulating fluidized bed technology. Fortunately most of the work on circulating fluidized beds has been published in two volumes. The first was Circulating Fluidized Bed Technology, Proceedings of the First International Conference on Circulating Fluidized Beds, Halifax, Nova Scotia, Canada, Nov. 18–20, 1985, edited by Prabir Basu, Pergamon Press (hereinafter CFB I) and, more recently, by Circulating Fluidized Bed Technology II, Proceedings of the Second International Conference on Circulating Fluidized Beds, Compiegne, France, 14–18 Mar. 1988, edited by Prabir Basu and Jean Francois Large, Pergamon Press (hereinafter CFB II).

Other workers were aware of the problems remaining in use of CFB units, see e.g. Analysis of Circulating Fluidized Bed Combustion Technology and Scope For Future Development, Takehiko Furusawa and Tadaaki Shimizu, page 51, in CFB II. The authors focused on three areas.

1. Heat Recovery
2. Design of Cyclones and Carbon Burn-Up
3. $NO_x$ Emissions

I realized that the problems of better carbon burning, and reduced $NO_x/SO_x$ emissions were related. This relationship can best be understood by reviewing the problem of emissions from CFB boilers.

Emissions From CFB Boilers

CFB boilers are being commercialized rapidly due to many factors. The first is fuel flexibility—CFB boilers can handle a mixture of fuels, including those rich in ash and moisture and fuels which are difficult to burn in conventional boilers. Some fuels combusted in commercial CFB boilers include: coals, wood waste, bark, petroleum coke, oil and gas, lignite, brown coal, peat, coal washings' rejects and industrial and sewage sludges. High combustion efficiencies, often 99%, are achieved. Fuel handling and feeding is simple, heat release rates are high, turndown and load following is excellent and CFBs have demonstrated excellent commercial availability records.

Most importantly, it is in low emission levels where CFB boilers have excelled. Low particulate, $SO_x$ and $NO_x$ emissions have allowed new CFB boilers to be installed in areas where permitting of conventional boilers to handle low grade fuels would have been impossible. Some of these areas include Southern California, Japan and Europe. With increasing concern over air quality, acid rain and smog, CFB boilers offer an excellent alternative to utilities and industrial users. Their rate of commercialization is expected to continue at the fast rate of the past eight years.

The good contact between gas and solids in a CFB combustion affords excellent sulfur capture by circulating fine limestone. Ca/S ratios of 1–4 are used, and the resulting gypsum can be disposed of safely. Sulfur capture efficiencies of over 90% are possible. With combustion temperatures of 1550°–1650° F., and staged combustion (typically half of the air is introduced as secondary air), $NO_x$ emissions can be kept down to the 50–300 ppm range. $NO_x$ emissions decrease as excess $O_S$ in the fuel gas is decreased. This is shown in FIG. 2, taken from FIG. 5 (N. Berge, $NO_x$ Control in a Circulating Fluidized Bed Combustor, CFB II, p. 426).

| | Typical Operating Conditions | |
|---|---|---|
| | Fixed ("bubbling") Fluid Bed Combustor | Circulating Fluid Bed Combustor |
| Temp, °F. | 1550 | 1650 |
| Pressure, psig | 2 | 3 |
| Superficial Velocity, ft/s | 3–12 | 15–25 |
| Entrainment lb/lb gms | 0.4–1 | 10–20 |
| gas residence time, sec | 0.5–1 | 3–4 |

Excess $O_2$ cannot be reduced below 2%, as at 1.5%, a sharp increase in CO occurs. This constraint is shown in FIG. 3, taken from FIG. 7 of the N. Berge publication.

Decreasing oxygen concentrations would decrease $NO_x$, but increase CO emissions. The best the unit could do would be to operate with enough air to achieve complete afterburning (20+% excess air!) and live with the $NO_x$ emissions.

In analyzing the operation of existing CFB units, I realized that a significant amount of bed elutriation, or separation of particulate matter based on differences in settling viscosities, occurred in the circulating fluidized bed, but that only limited use was made of this segregation.

I realized that many of the deficiencies of CFB units could be overcome if it would be possible to maintain a generally reducing atmosphere in a lower region of the CFB combustor, while having a more oxidizing atmosphere in the upper portion of the CFB combustor, to meet CO emissions specs.

CFB operators have recognized the benefits of a reducing atmosphere during combustion of coal or other carbonaceous material, but have achieved only limited success from staged air injection. Part of the problem is that starving the base of the coke combustor increases the need for oxygen containing gas in an upper part of the coke combustor, and there is not sufficient residence time in the upper part of the coke combustor to achieve satisfactory combustion of CO to $CO_2$.

Operation with staged CO combustion generally reduces $NO_x$ emissions, but at the price of increased CO emissions. Usually even more excess air is added, on the order of 25–40 percent excess air, to enhance CO burning and compensate for the reduced burning activity in the reducing section of the bed.

I realized that addition of a conventional CO combustion promoter, such as the platinum or palladium promoters used in FCC units, in an unconventional way to a CFB boiler, would permit more efficient operation of the CFB unit, a significant reduction in the amount of excess air required to achieve complete CO combustion, and reduced $NO_x$ emissions.

BRIEF SUMMARY OF THE INVENTION

In one embodiment the present invention provides in a circulating fluidized bed combustion zone wherein a carbon-containing material is burned by contact with an oxygen-containing gas in a generally vertical combustor comprising a fast fluidized bed of particulates wherein at least a majority of the particulate matter in the fast fluidized bed has a particle diameter in excess of 100 microns, to generate a flue gas/particulate stream which is discharged from the top of the combustor, said flue gas stream comprising flue gas, fines having a particle diameter less than about 100 microns, and circulating particles having an average particle size within the range of about 100–400 microns, which flue gas stream passes through a separation means to recover from the flue gas at least a majority of the 100–400 micron particles which are recycled to the circulating fluidized bed combustion zone, the improvement comprising adding to the combustor a CO combustion promoter in an amount equal to 0.001 to 100 wt. ppm, based on the weight of circulating particles, of a promoter selected from the group of Pt, Pd, Ir, Rh, Os and compounds and mixtures thereof, and wherein said promoter is on a support having an average particle diameter within the range of about 400 to 1200 microns.

In another embodiment the present invention provides in a circulating fluidized bed combustion process wherein a carbonaceous material containing sulfur and nitrogen impurities is burned by contact with air in a generally vertical combustor comprising a fast fluidized bed of particulates, wherein at least a majority of the circulating particulate matter in the fast fluidized bed has a particle diameter in the range of about 100 to 400 microns, and at least 25 wt.% of the circulating particulate matter in said bed comprises a sulfur accepting material, and wherein combustion of the carbonaceous material occurs in a lower portion of said fast fluidized bed to produce a dilute phase fluidized bed comprising carbon monoxide, carbon dioxide, $SO_x$ and $NO_x$, circulating particulates in 100–400 microns in diameter comprising sulfur acceptor, and fines generated in said fast fluidized bed, wherein said dilute phase fluidized bed is passed to a separation means which recovers essentially all of the particulates in excess of 100 microns equivalent diameter and which discharges a majority of the fines with flue gas, and particulates in excess of 100 microns diameter are recovered from said dilute phase fluidized bed and are recycled to the fast fluidized bed, the improvement comprising adding to the combustion zone a CO combustion promoter on a support having an average equivalent particle diameter of about 400 to 1200 microns, and a surface area in excess of 20 $m^2/g$, and wherein the CO combustion promoter is present in an amount equal to 0.001–100 wt. ppm of a metal or metal compounds selected from the group of Pt, Pd, Rh, Os, Ir.

In another embodiment the present invention provides a process for the circulating fluid bed combustion of coal in a fast fluidized bed comprising a circulating sulfur acceptor material a majority by weight of said circulating material comprising particulates of 100–400 microns, and which reacts with sulfur oxides formed during coal combustion characterized by adding to the circulating fluid bed combustion unit a CO combustion promoter selected from the group of Pt, Pd, Ir, Rh, Os and mixtures and compounds thereof in an amount equal to 0.001 to 100 wt. ppm, on an element betal basis, said promoter being disposed on a porous support having an average particle diameter within the range of about 400–1200 microns, a surface area in excess of 20 $m^2/g$, and operating with 100–105 percent of the air required by stoichiometry for complete combustion of the coal in the circulating fluidized bed combustion unit.

DETAILED DESCRIPTION

This is a mature, commercial process, with about 100 units in operation or under construction as of 1988. A detailed description thereof is not believed necessary. Further details may be taken from Circulating Fluidized Bed Technology II, previously discussed, which is incorporated herein by reference. Additional details of circulating fluidized bed combustors may also be taken from the U.S. Patents incorporated by reference in the background discussion.

Figure 1:
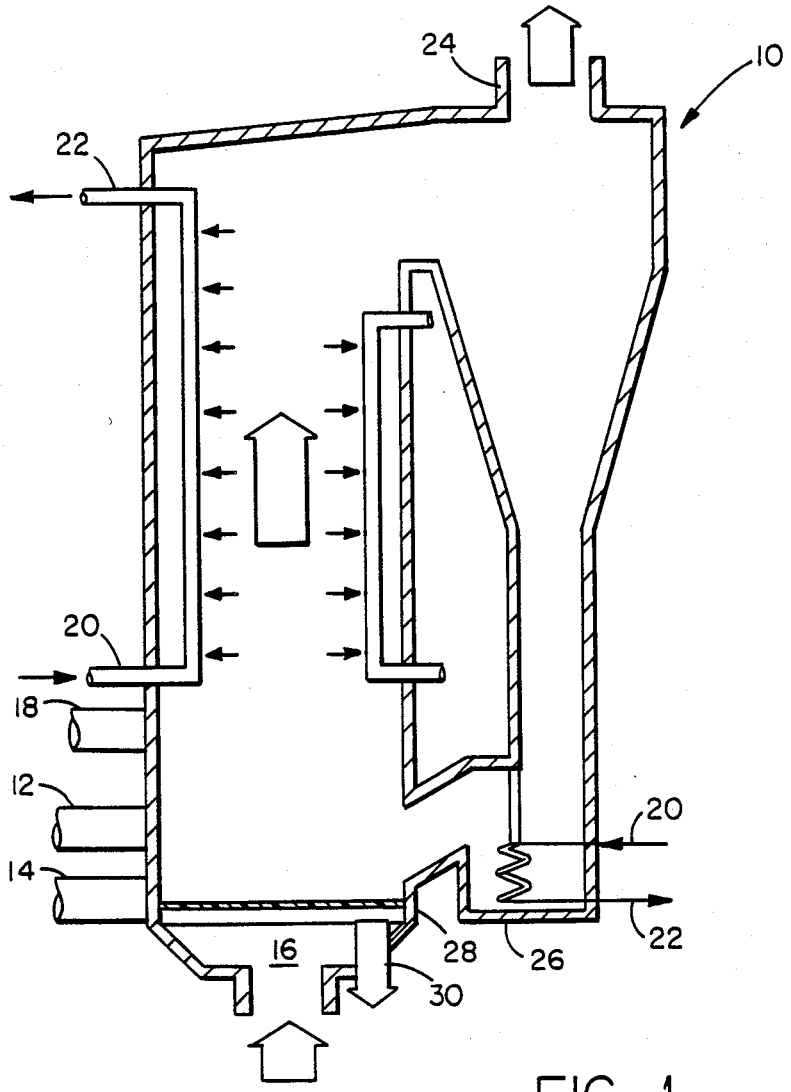
FIG. 1 (PRIOR ART)
FIG. 1 (Prior Art) is a simplified, schematic, cross-sectional view of a circulating fluid bed combustor.
Figure 2:
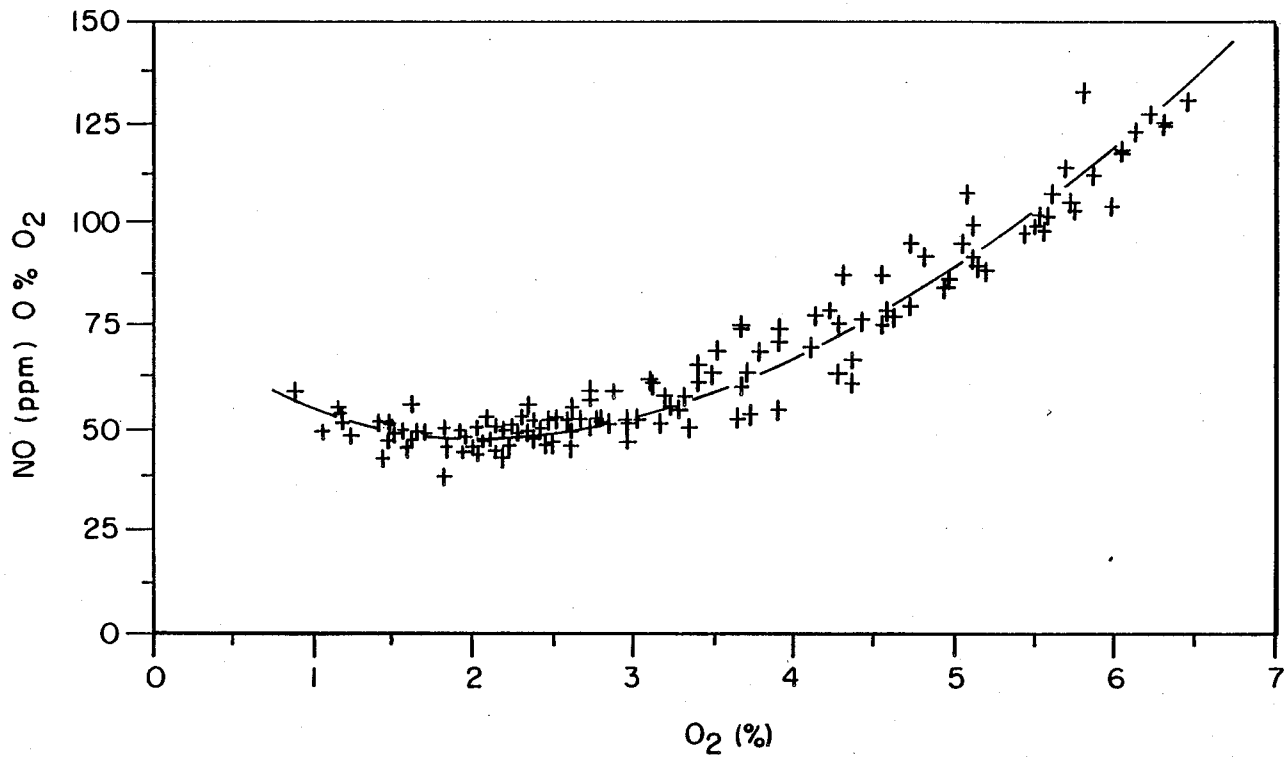
FIG. 2 illustrates how $NO_x$ emissons change with flue gas oxygen content, in commercial CFB units.
Figure 3:
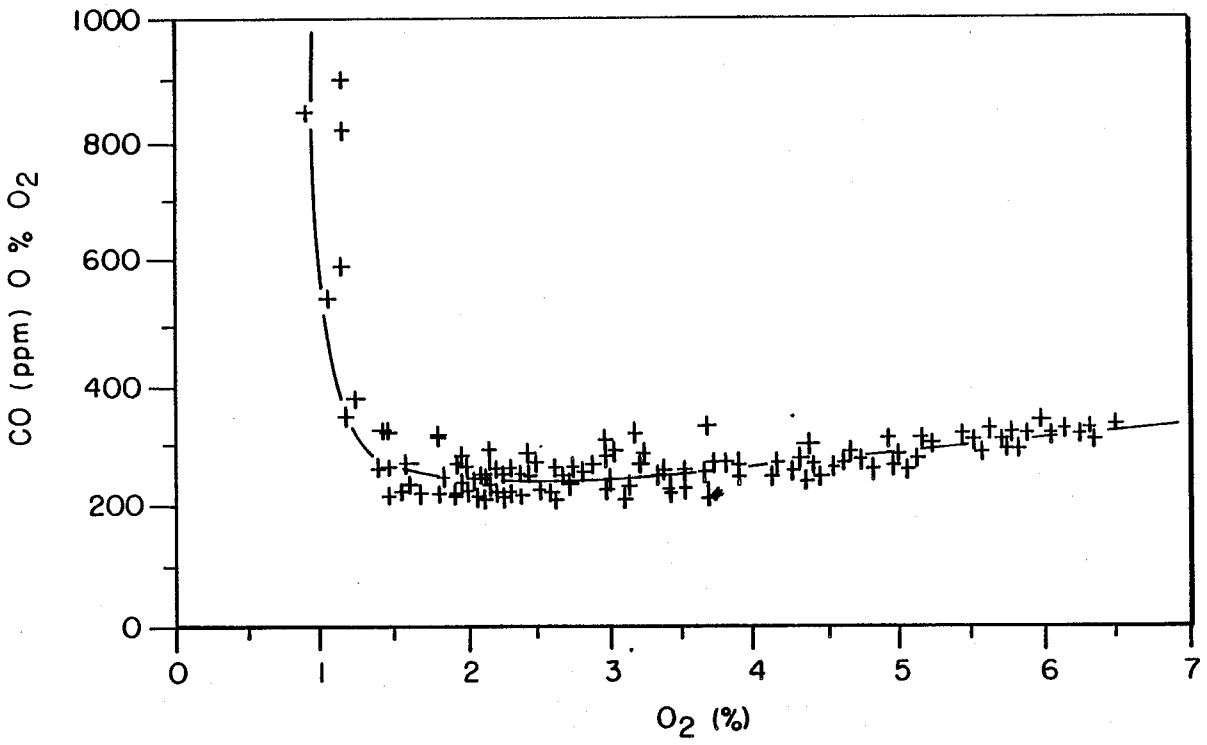
FIG. 3 shows how CO emissions change with flue gas $O_2$ content in commercial units.

The typical circulating fluid-bed combustor illustrated in FIG. 1 shows a combustor 10 fed with a source of inert particles such as crushed limestone, through conduit 12 and fuel through conduit 14 together with a source of primary air through conduit 16 which ordinarily provides about 40–80% of the air required for combustion. A source of secondary air is fed through conduit 18 which provides the remaining 20–60% of the air necessary for combustion. Water circulating through heat exchangers 20, 20' is turned into steam when exiting conduits 22, 22' of the heat exchangers 20, 20'. Gaseous products of combustion (flue gas) are removed through outlet 24 of combustor 10 with a recycle of the limestone and incompletely burned occurring in conduit 26. Ash may be removed through grate 28 and through conduit 30 to a site remote from combustor 10. The fuel fed through conduit 14 may include hazardous wastes and sludges which are otherwise expensive to dispose of. The combustor can also burn coil, low-value petroleum coke, or other refinery products. For example, in refineries limited by fuel gas production, excess fuel gas, such as FCC fuel gas, can be burned in the CFB combustor in combination with other fuels.

COMBUSTION PROMOTER METALS AND SUPPORT PROPERTIES

Preferably, the CO combustion promoter is a highly porous support. The support preferably has a porosity exceeding 50 percent. The particle density should be within the range of 1.4–2.4 g/cc, and preferably within the range of 1.5–2 g/cc. Many highly porous aluminas have particle densities of about 2 g/cc and are ideal for use herein.

A majority, and preferably in excess of 90% of the CO combustion promoter is not on the outer surface of the promoter support. Conventional exchange/impregnation techniques will distribute the CO combustion promoter throughout the support particle.

The CO combustion promoter is preferably dispersed on a material having relatively high surface area, e.g., a surface area in excess of 50 or even in excess of 500 meters sq./g, and preferably having a surface area of 75–250 m sq./g.

Alumina is an ideal support for the CO combustion promoter, because of its porosity, density, and high surface area. All of these physical properties are essential to keep the platinum in a highly dispersed stae, where it can promote rapid afterburning of carbon monoxide to carbon dioxide. Silica, silica:alumina, Kaolin, and similar materials may be used.

By way of contrast, sand is not a good support for the platinum CO combustion promoter contemplated herein. Sand is not a porous material The Pt is all on the surface, and too readily clogged by ash and/or erosion or abrasion losses. Sand's density is also somewhat higher than preferred, typically around 2.5 g/cc.

The amount of CO combustion promoter required can vary greatly, depending on the efficiency of its use within the unit, the temperature at which the unit operates, and the amount of combustion promoter metal which is occluded or covered up by slag, fly ash, etc.

Operation with an amount of CO combustion promoter equivalent in activity to 0.001-100 ppm platinum, based on the total weight of solids circulating in the CFB, is preferred. Because of the high temperatures at which CFB units operate, it will be possible in many instances to operate with significantly less platinum, e.g., 0.01-10 wt. ppm platinum (or an equivalent amount of other CO combustion promoting metal, i.e., 3-5 wt. ppm $O_5$ is roughly equivalent to 1 wt. ppm Pt) may be used herein. In many units operation with 0.1-5 ppm platinum equivalents will give very good results.

Operation with much greater amounts of CO combustion promoter is possible, e.g., equivalent to 100-500 ppm Pt, but is usually not necessary and adds to the cost of the process, so such operation is not preferred.

Any CO combustion promoter metals now used in fluidized catalytic cracking (FCC) units may be used herein. Pt, Pd, Ir, Rh, and Os may be used alone or in combinations. Some combinations, such as Pt/Rh, seem to reduce somewhat $NO_x$ emissions and may be preferred for use herein.

Although the same metals used to promote CO combustion in FCC units may be used in the process of the present invention, the conventional CO combustion promoter particles used in FCC are not suitable for use herein.

In typical FCC applications, the promoter material is present as platinum or some other CO combustion promoting metal, on a highly porous port, typically with an average particle size range of 40-80 microns. Typically the promoter contains 0.02, 0.1, or perhaps even 0.5 to 1 wt.% platinum. Typically the promoter contains 0.1 wt.% platinum.

If a drum of such CO combustion promoter were added to a CFB unit, all that would happen is that the promoter would be promptly swept out of the unit with the fly ash. The average particle size of the fly ash from most CFB units is about 75 microns. Some coals have 10-20 percent ash, so CFB units must efficiently remove particles below the size of the circulating dolomite, limestone, sand, etc., used to maintain a fluidized bed for heat exchange purposes. Ash is efficiently removed in CFB units by the use of low efficiency cyclones with exceedingly poor retention of particles less than 100-150 microns in diameter.

FAST SETTLING PROMOTER SUPPORT

The CO combustion promoter should be on a catalyst support particle having a settling velocity well in excess of the 100-400 micron particles which compose the bulk of the circulating material in a CFB unit. Ideally, the fast settling CO combustion promoters of the present invention will not circulate in the circulating fluid bed, but instead will "slip" so rapidly in the CFB combustor that they have an extremely long residence time relative to the 100-300 micron circulating material or even remain relatively stationary within the CFB bed. Much segregation in CFB combustors now occurs, i.e., at the lower region of the CFB unit are large particles of coal, wood chips, etc., large particles of lime, dolomite, etc. segregate. These large pieces remain in the lower portion of the bed due to their large size, weight and terminal velcity. These large particles may, to some extent, act as a fragmented support for the fast settling promoter.

By use of fast settling particles with a terminal velocity intermediate the terminal velocity of the large particles in the base of the fluidized bed, and the terminal velocity of the 100-400 micron particles of dolomite, clay, sand, etc., which circulate readily, it is possible to maintain at an intermediate portion of the CFB combustion zone the fast settling CO combustion promoter of the invention.

This has many advantages. The CO combustion promoter, at the 1300°-1700° F. temperatures contemplated for use herein, functions as an extremely efficient oxidation catalyst. Operation with as little as 0.001-100 ppm Pt equivalent CO combustion promoter metal will profoundly decrease CO emissions.

Because of the high settling velocity of the CO combustion promoter, very little of it will circulate through the CFB unit, and essentially none of it will be lost in the cyclones. Because the promoter tends to remain stationary, or for an extended period of time if not stationary, in the middle and upper regions of the CFB combustor zone, it will spend very little time in the lower regions where extremely high temperatures can be experienced due to localized burning. The "suspended" combustion promoter will be protected to some extent from fly ash deposition. In some CFB units, some of the ash content of the coal is removed as large agglomerates out the bottom of the CFB unit. Some units permit continuing removal of large ash agglomerates, while others remove ash intermittantly. Most of the fly ash is removed with the flue gas, even in units where ash agglomeration is a problem.

Another benefit to use of fast settling promoter is that the Pt, etc., is segrated where it is most needed, namely in the CO and $O_2$ rich regions just above the coke or coal burning zone in the combustor. CO combustion promoter does nothing useful in e.g., the cyclone dipleg.

It is believed that much of the ash agglomeration occurs during passage through the base of the combustor zone, so the life of the fast settling CO combustion promoter will be significantly extended due to its relatively permanent suspension above this combustion zone.

The CO combustion promoter may be disposed on particles having an average particle size of 200-6000 microns, and preferably on particles of 500-5000 microns average diameter, and most preferably, on 750-2500 micron sized particles.

For optimum results, the CO combustion promoter is sized so that it will tend to float above the relatively dense phase fluidized bed (where large particles of e.g., coal are burning) and remain for an extended period in the relatively dilute phase region which typically occupies the upper 50-90% of the volume of the combustor. Thus, the preferred size of the CO combustion promoter is 400-1200 microns, and more preferably 500-1000 microns, with the most preferred size being 550-750 microns.

AIR INJECTION

In order to minimize power consumption, and waste of low grade energy by heating up excess flue gas being discharged up the stack, it will be beneficial in many cases to closely monitor CO and/or $O_2$ concentrations of stack gas so that less than 5% excess air is provided, and preferably less than 5%, and most preferably less than 2% excess air. Thus my process may operate with about an order of magnitude less excess air as compared to prior art CFB units.

Rather than cut down on air addition rates, the process of the present invention also allows significant increases in charge rate of combustible material, without requiring additional air blower capacity, and/or an increase in the size of the CFB combustor. The only limitation would be the ability of heat exchange means to recover the greater amount of heat release associated with an increase in, e.g., coal charge rates of the CFB combustor.

STAGED AIR INJECTION

Preferably, one or more stages of air injection are supplied at various elevations within the CFB combustor. Staged air injection preferably provides 70–90 percent of the air required by stoichiometry in the densest region of the bed. The density of this region will vary somewhat from unit to unit, or in the same unit depending on throughput, material being burned, etc. In general terms, the highly expanded, fast fluidized bed for particulates has an average particle diameter in excess of about 200 microns. Typically this highly expanded bed will occupy from 10–40 percent of the vertical distance of the CFB combustor. Above this fast fluidized bed is a more dilute phase region.

Preferably enough air is added immediately downstream of the fast fluidized, expanded bed region to increase the total amount of oxygen present to 100–110 percent of that required by stoichiometry for complete combustion of CO to $CO_2$. Because of the excellent CO burning rates which can be achieved in the presence of the CO combustion promoter of the present invention, it is not necessary to operate with gross excesses of air such as has been done in the prior art.

EXAMPLE 1. (PRIOR ART)

The following example represents operating conditions in a circulating fluid bed boiler unit which was reported in the literature. The unit is a little unusual in that the feed was wood chips, rather than coal, so a sulfur capturing sorbent was not required to meet $SO_x$ emission limits. A solid particulate material was necessary for proper operation of the unit, so sand was added for heat transfer, proper bed fluidization, etc. Two CFB boiler designs are reported, a Babcock-Ultra Powered CFB boiler and an Energy Factors CFB boiler. Table 1, F. Belin, D. E. James, D. J. Walker, R. J. Warrick "Waste Wood Combustion in Circulating Fluidized Bed Boilers", reported in Circulating Fluidized Bed Technology, II at page 354.

TABLE I

Babcock & Wilcox CFB Boiler Performance Data

| | Unit | Babcock-Ultrapower Design | Babcock-Ultrapower Test | Energy Factors, Design | Energy Factors, Test |
|---|---|---|---|---|---|
| Electric Load (Gross) | MW | 27.5 | 28.3 | 19.5 | 19.6 |
| Max Steam Flow (MCR) | kg/s | 27.6 | 26.4 | 20.7 | 21.5 |
| | 1000 lb/hr | 218.6 | 209.0 | 164.0 | 170.8 |
| Steam Pressure | bar | 86.2 | 85.9 | 87.5 | 87.2 |
| | psig | 1250 | 1245 | 1270 | 1265 |
| Steam Temperature | °C. | 513 | 511 | 513 | 509 |
| | °F. | 955 | 951 | 955 | 949 |
| Feedwater Temperature | °C. | 147 | 151 | 186 | 196 |
| | °F. | 296 | 303 | 367 | 385 |
| Gas/Air Temperatures | | | | | |
| Furnace Exit Gas | °C. | 857 | 873 | 849 | 823 |
| | °F. | 1575 | 1603 | 1560 | 1514 |
| Flue Gas leaving | °C. | 135 | 128 | 150 | 152 |
| Air Heater | °F. | 275 | 263 | 302 | 305 |
| Air Leaving, Air | °C. | 209 | 203 | 191 | 189 |
| Heater | °F. | 408 | 398 | 375 | 372 |
| Thermal Efficiency (HHV Basis) | % | 78.8 | 79.81 | 81.3 | 81.28 |
| Fuel Moisture | % | 40.0 | 38.0 | 30.0 | 46.4 |
| Unburned Carbon Loss | % | 1.2 | .01 | 1.2 | 0.09 |
| Excess Air | % | 16 | 24 | 21 | 19 |
| Primary/Overfire Air Split | % | 50/50 | 50/50 | 60/40 | 25/75 |
| Emissions at MCR | | Limits: | | Limits: | |
| $NO_x$ | lb/$10^6$ Btu | 0.158 | .155 | .175 | 0.110 |
| CO | lb/$10^6$ Btu | 0.158 | .025 | .218 | 0.100 |

ILLUSTRATIVE EMBODIMENT (INVENTION)

In this example I have estimated the changes that would occur due to the addition of 1 ppm platinum to the circulating solids inventory in the Babcock-Ultrapower unit. I would add the platinum as a Pt on silica/alumina support having a particle density of about 2.0–2.5 g/cc or higher and an average particle size of about 500. These could be made by spray drying marumerizing, pilling, oil drop, etc. Alumina or silica or silica/alumina is preferred. The promoter would be similar to that used in conventional FCC catalyst, but quite a bit larger than catalyst used in FCC units, and somewhat heavier. The promoter would contain 0.1 wt.% platinum, so addition of 1 wt.% additive to the circulating inventory in the CFB would give 1 ppm platinum.

The change that would occur if unit operation were otherwise maintained as described in Table I, is a profound reduction in CO emissions.

I would prefer to reduce excess air, and/or increase fuel addition rate, up to the limit of the units heat exchanger capacity.

In designing a new unit, I would design and make the combustion zone, cyclones, and air blow smaller because of the reduction in air rates permitted by the invention.

I would prefer to use CO combustion promoters having a terminal velocity of at least 80% of the design superficial gas velocity in the CFB, up to 120%. The fast settling CO combustion promoters will have only limited circulation in the CFB, and will give a higher apparent concentration in the CFB than their concentration in the units circulating inventory of particulates.

The fast settling CO combustion promoters will rarely encounter the CFB cyclones, and will have essentially 100% recovery rates in the cyclones.

The promoter support, being both large and strong, will have an exceptionally long life in the CFB unit. There will be little degredation of the CO combustion when the promoter is passing through localized hot spots in the very base of the fast fluidized bed combustion zone, because the promoter will remain suspended above this zone.

I claim:

1. In a circulating fluidized bed combustion zone wherein a carbon-containing material is burned by contact with an oxygen-containing gas in a generally vertical combustor comprising a fast fluidized bed of particulates wherein at least a majority of the particulate matter in the fast fluidized bed has a particle diameter in excess of 100 microns, to generate a flue gas/particulate stream which is discharged from the top of the combustor, said flue gas stream comprising flue gas, fines having a particle diameter less than about 100 microns, and circulating particles having an average particle size within the range of about 100–400 microns, which flue gas stream passes through a separation means to recover from the flue gas at least a majority of the 100–400 micron particles which are recycled to the circulating fluidized bed combustion zone, the improvement comprising adding to the combustor a CO combustion promoter in an amount equal to 0.001 to 100 wt. ppm, based on the weight of circulating particles, of a promoter selected from the group of Pt, Pd, Ir, Rh, Os and compounds and mixtures thereof, and wherein said promoter is on a support having an average particle diameter within the range of about 400 to 1200 microns.

2. The process of claim 1 wherein the CO combustion promoter is platinum, and is present in an amount equal to 0.01 to 50 wt. ppm.

3. The process of claim 1 wherein the amount of CO combustion promoter present is equivalent in CO oxidation activity to 0.05 to 10 wt. ppm Pt.

4. The process of claim 1 wherein the CO combustion promoter comprises Pt/Rh.

5. The process of claim 1 wherein the CO combustion promoter is impregnated on a porous support, having an average particle diameter within the range of 500 to 1000 microns and a surface area of at least 20 $m^2/g$.

6. The process of claim 1 wherein the CO combustin promoter is on a support having an average equivalent particle diameter within the range of 550–750 microns, an average particle density of 1.5–2.5 g/cc, and a surface area in excess of 50 $m^2/g$.

7. The process of claim 1 wherein the CO combustin promoter is on a support selected from the group of silica, alumina, silica/alumina, Kaolin and mixtures thereof.

8. The process of claim 1 wherein the CO combustion promoter comprises a promoter metal or metal compound rich core within a promoter deficient shell.

9. In a circulating fluidized bed combustion process wherein a carbonaceous material containing sulfur and nitrogen impurities is burned by contact with air in a generally vertical combustor comprising a fast fluidized bed of particulates, wherein at least a majority of the circulating particulate matter in the fast fluidized bed has a particle diameter in the range of about 100 to 400 microns, and at least 25 wt.% of the circulating particulate matter in said bed comprises a sulfur accepting material, and wherein combustion of the carbonaceous material occurs in a lower portion of said fast fluidized bed to produce a dilute phase fluidized bed comprising carbon monoxide, carbon dioxide, $SO_x$ and $NO_x$, circulating particulates 100–400 microns in diameter comprising sulfur acceptor, and fines generated in said fast fluidized bed, wherein said dilute phase fluidized bed is passed to a separation means which recovers essentially all of the particulates larger than the fines and discharges a majority of the fines with flue gas, and particulates of 100–400 microns diameter are recycled to the fast fluidized bed, the improvement comprising adding to the combustion zone a CO combustion promoter on a support having an average equivalent particle diameter of about 400 to 1200 microns, and a surface area in excess of 20 $m^2/g$, and wherein the CO combustion promoter is present in an amount equal to 0.001–100 wt. ppm of a metal or metal compounds selected from the group of Pt, Pd, Rh, Os, Ir, and mixtures thereof.

10. The process of claim 9 wherein the CO combustion promoter is platinum, and is present in an amount equal to 0.01 to 50 wt. ppm.

11. The process of claim 9 wherein the CD combustion promoter comprises Pt/Rh.

12. The process of claim 9 wherein the CO combustion promoter is impregnated on a porous support, having an average particle diameter within the range of about 500 to 1000 microns and a surface area of at least 20 $m^2/g$.

13. The process of claim 9 wherein the CO combustion promoter is on a support having an average equivalent particle diameter within the range of 550–750 microns, an average particle density of 1.5–2.5 g/cc, and a surface area in excess of 50 $m^2/g$.

14. The process of claim 9 wherein the CO combustion promoter is on a support selected from the group of silica, alumina, silica/alumina, Kaolin and mixtures thereof.

15. The process of claim 9 wherein the CO combustion promoter comprises a promoter metal or metal compound rich core within a promoter deficient shell.

16. A process for the circulating fluid bed combustion of coal in a fast fluidized bed comprising a circulating sulfur acceptor material a majority by weight of said circulating material comprising particulates of 100–400 microns, and which sulfur acceptor reacts with sulfur oxides formed during coal combustion and a flue gas comprising CO is produced characterized by adding to the circulating fluid bed combustion unit a CO combustion promoter selected from the group of Pt, Pd, Ir, Rh, Os and mixtures and compounds thereof in an amount equal to 0.001 to 100 wt. ppm, on an element betal basis, said promoter being disposed on a porous support having an average particle diameter within the range of about 400–1200 microns, a surface area in excess of 20 $m^2/g$, and operating with 100–105 percent of the air required by stoichiometry for complete combustion of the coal in the circulating fluidized bed combustion unit.

17. The process of claim 16 wherein the CO combustion promoter is impregnated on a porous support having an average particle diameter within the range of about500 to 1000 microns and a surface area of at least 20 $m^2/g$.

18. The process of claim 16 wherein the CO combustion promoter is on a support having an average equivalent particle diameter within the range of 550–750 microns, an average particle density of 1.5–2.5 g/cc, and a surface area in excess of 50 $m^2/g$.

* * * * *